United States Patent [19]

Dikstein

[11] Patent Number: 5,037,010

[45] Date of Patent: Aug. 6, 1991

[54] DISPENSING CONTAINER FOR VISCOUS SUBSTANCES

[75] Inventor: Shabtai Dikstein, Jerusalem, Israel

[73] Assignees: Resdevco Research & Development Co. Ltd., Jerusalem; Lageen Box & Can Factory Ltd., Yagur, both of Israel

[21] Appl. No.: 378,270

[22] Filed: Jul. 11, 1989

[51] Int. Cl.[5] ..... B67D 5/42

[52] U.S. Cl. ..... 222/390; 222/405; 206/804

[58] Field of Search ..... 222/390, 319, 405; 206/804

[56] References Cited

U.S. PATENT DOCUMENTS

| | | | |
|---|---|---|---|
| 1,025,512 | 5/1912 | Craven . | |
| 1,055,028 | 3/1913 | Fynn et al. | 222/390 |
| 1,642,108 | 9/1927 | Geake . | |
| 1,651,687 | 12/1927 | Fislar . | |
| 1,772,887 | 8/1930 | De Couët . | |
| 1,936,822 | 11/1933 | Boenecke | 222/390 |
| 2,335,049 | 11/1943 | Finkelstein . | |
| 2,568,856 | 9/1951 | Hartmann . | |
| 2,599,379 | 6/1952 | Gabler . | |
| 2,605,936 | 8/1952 | Gabler . | |
| 2,626,730 | 1/1953 | Gabler . | |
| 2,627,365 | 2/1953 | Gabler . | |
| 2,635,789 | 4/1953 | Gabler . | |
| 2,656,953 | 10/1953 | Rich . | |
| 2,818,973 | 1/1958 | Croce et al. | 206/804 |
| 3,059,820 | 7/1960 | Gabler . | |
| 3,128,923 | 3/1962 | Gabler . | |
| 3,241,729 | 11/1964 | Gabler . | |
| 4,022,205 | 5/1977 | Tenczar . | |
| 4,139,127 | 2/1979 | Gentile . | |

FOREIGN PATENT DOCUMENTS

| | | |
|---|---|---|
| 531026 | 8/1931 | Fed. Rep. of Germany . |
| 1377658 | 9/1964 | France . |
| 615081 | 6/1961 | Italy . |
| 248596 | 5/1925 | United Kingdom . |
| 401003 | 5/1932 | United Kingdom . |
| 468029 | 12/1936 | United Kingdom . |
| 514844 | 11/1939 | United Kingdom . |
| 650054 | 12/1947 | United Kingdom . |
| 755224 | 1/1954 | United Kingdom . |
| 963207 | 6/1962 | United Kingdom . |
| 1035945 | 3/1963 | United Kingdom . |
| 1307700 | 10/1970 | United Kingdom . |
| 03572 | 10/1983 | World Int. Prop. O. . |

*Primary Examiner*—Michael S. Huppert
*Assistant Examiner*—Gregory L. Huson
*Attorney, Agent, or Firm*—Owen, Wickersham & Erickson

[57] ABSTRACT

A dispensing container for a viscous substance comprising a sleeve defining an axis of rotation and having a pair of ends arranged at first and second locations along the axis, the sleeve further defining a helical travel path on an inward facing surface thereof. A dispensing member mounted in association with one of the pair of ends of the sleeve, and, a piston head mounted within the sleeve and defining an outward facing peripheral surface operative to cooperate with the helical travel path and further defining with the dispensing member and a portion of the sleeve extending therebetween a storage volume for the viscous substance. The piston head travels along the axis of rotation when undergoing rotation thereabout relative to the sleeve, a linkage apparatus is integrally formed with the piston head and defining an end portion associated with a predetermined portion of the sleeve. The linkage apparatus permits axial displacement of the piston head relative to the predetermined portion proportional to the distance between the predetermined portion and the dispensing member, and an apparatus is provided for engaging the end portion of the linkage apparatus and thereby preventing simultaneous rotation of the piston head and the sleeve in the same direction to facilitate axial displacement of the piston head.

23 Claims, 6 Drawing Sheets

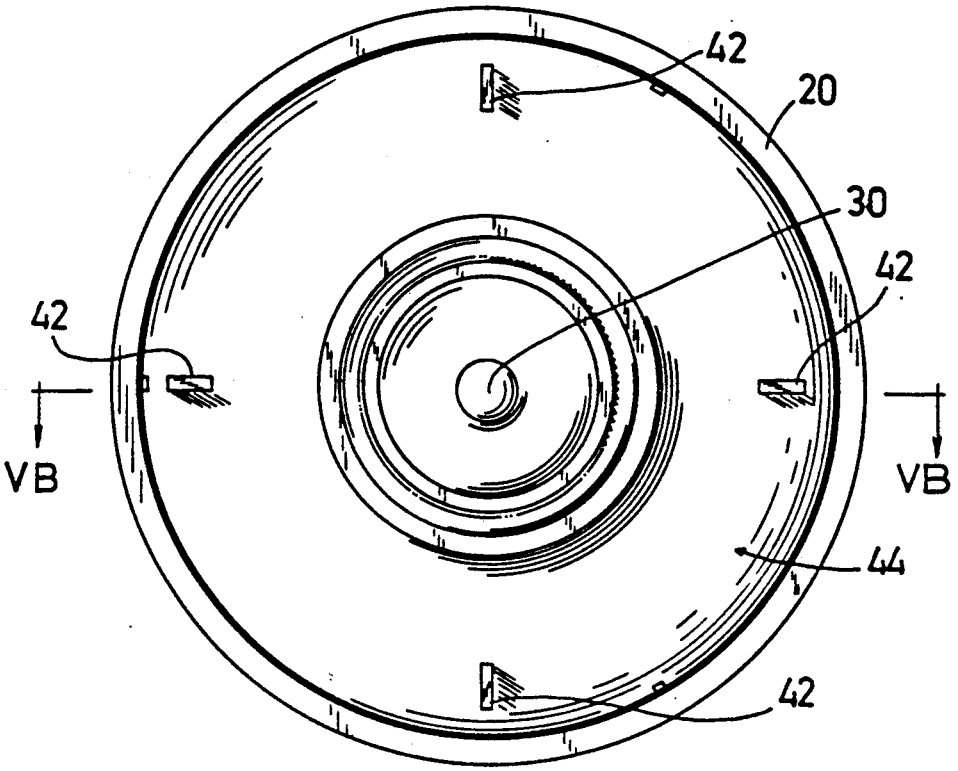
FIG 5A
FIG 5B
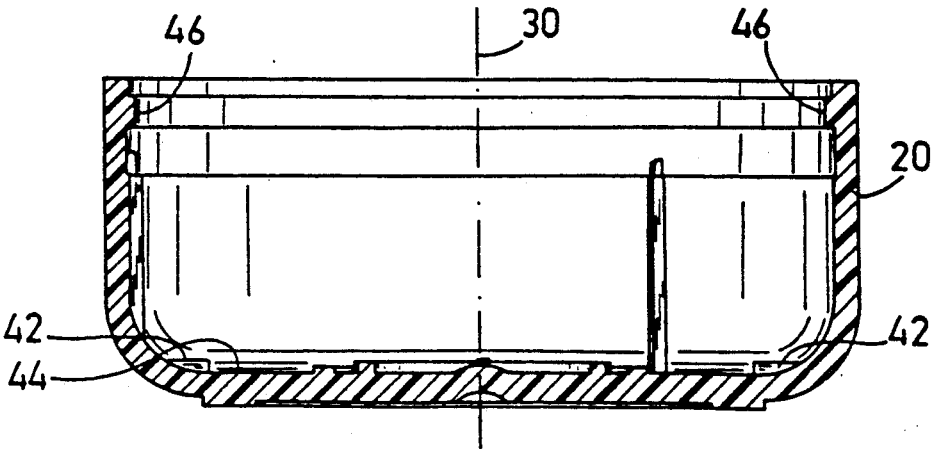

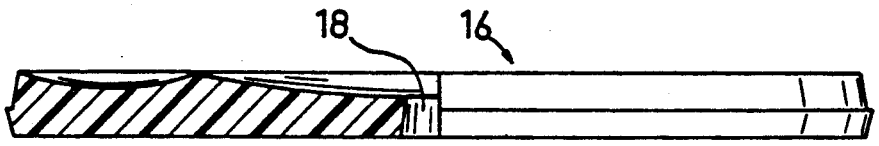
FIG 6
FIG 7
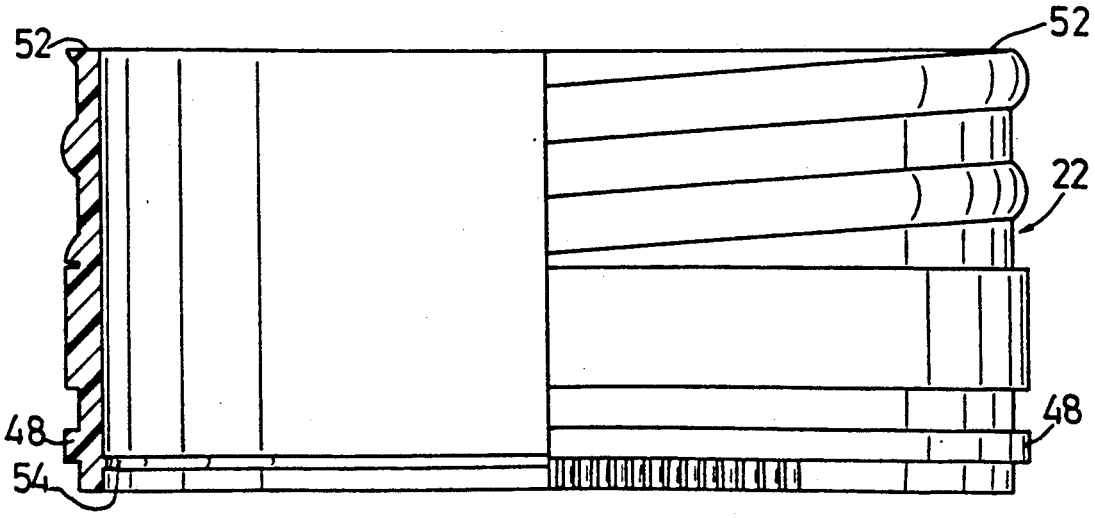

DISPENSING CONTAINER FOR VISCOUS SUBSTANCES

FIELD OF THE INVENTION

The present invention relates generally to dispensing containers for viscous substances and, particularly, to such containers that are operative to prevent the substance contained therein from becoming contaminated.

BACKGROUND OF THE INVENTION

It is well known for creams, gels and other similarly viscous substances to be sold in small, typically cup-shaped, containers with a protective cover. In order to use the substance contained in such a container, a user removes the cover and by dipping his finger into the substance may remove a small amount thereof. Particularly in the area of cosmetics and substances having medical applications, it is desirable to keep the substance in the container in an uncontaminated state.

This is, however, not achieved with containers such as those described above, as the finger of a user is unlikely to be totally germ free and by dipping his finger into the substance in the container, the user causes the substance to become contaminated.

Disclosed in U.S. Pat. No. 3,128,923 and French Patent No. 1,377,658, both to Gabler, are containers for receiving and delivering pasty substances, each container comprising a jar-shaped container having a cover, an inverted cup placed within the container and being attached thereto by means of a cylindrical sleeve. The inverted cup defines an extrusion aperture in a base portion thereof and a screw thread on an inward-facing surface thereof. There is also provided a disk-like element threadably mounted within the inverted cup parallel to the base portion and defining, together with a portion of the inverted cup, a storage volume for the pasty substance. The disk-like element is pressed towards the base portion of the cup by a spring provided between the disk-like element and the container. The height of the spring is unrelated to the height of the container.

Among disadvantages inherent in the Patents to Gabler are that the containers disclosed have relatively complex structures. This is exemplified by the disk-like element and the spring being discrete members, rather than a single integral member.

Disclosed in U.S. Pat. No. 1,642,108 to Geake is a Dispensing Container comprising a cylindrical container having an open end, a rotatable cap member defining an extrusion orifice and mounted onto the open end of the container, a helical member placed within the container and extending axially therewithin, the helical member being fixed at one end to the cap member while being in rotational contact with a closed end of the container, there also being provided a disk-shaped piston member made of cork, located between the open and closed ends of the container and oriented parallel to the cap member and mounted onto the helical member.

As the cap member is rotated in a predetermined sense the piston member is driven along the helical member towards the cap member, thus causing a substance contained between the piston member and the cap member to be extruded through the orifice.

A particular disadvantage of the container to Geake is that although there are also disclosed pin members for reinforcing the piston member and for ensuring stability between the piston member and the helical member, after a relatively short period of time the piston member may suffer from wear, not only at its connection location with the helical member, but also at a contact edge between the piston member and the container. Moreover, no protective cover is provided to prevent contamination of a substance within the container.

Disclosed in U.S. Pat. No. 3,059,820, also to Gabler, is a Box for Holding and Delivering Pasty Substances comprising a shallow cylindrical container with a slip-on lid, a disk-like cover portion mounted within the container and defining an orifice, a piston threadably mounted within the container and parallel to the cover portion and a leaf spring, located between and fixed to a rotatable bottom portion of the container and the piston, the spring exerting a force on the piston in the direction of the cover portion. A pasty substance is contained between the piston and the cover portion. As the bottom portion is rotated in a predetermined direction, the spring and the cover portion are rotated accordingly and the pasty substance is extruded through the orifice.

A particular disadvantage of the box to Gabler is that due to the use of a leaf spring, the full depth of the container cannot be used for storage of the pasty substance. In addition, the box has a relatively complex structure.

Disclosed in U.S. Pat. No. 4,139,127 to Gentile is a Plunger-Type Dispenser with a Ratchet Actuator. The dispenser comprises a cylindrical reservoir for a viscous material to be dispensed, a rotatable cover defining apertures, a centrally-located screw extending between the rotatable cover to which it is fixed and a bottom surface of the reservoir and a plunger oriented parallel to the rotatable cover and mounted onto the screw, the viscous material being retained between the plunger and the rotatable cover.

As the cover is rotated in a predetermined sense, the screw is rotated correspondingly such that the plunger moves along the screw towards the cover, thereby causing extrusion of the viscous material. There is also provided a protective lid for the container.

A disadvantage of the Dispenser to Gentile is that, due to the presence of the centrally-located screw, the dispenser may not be filled by conventional apparatus but it instead requires specialized equipment for filling.

SUMMARY OF THE INVENTION

It is an aim of the present invention to provide an inexpensive, hygienic dispensing container for viscous substances in general and particularly for such substances as it may be sought to protect from contamination.

There is provided, therefore, in accordance with an embodiment of the invention, a dispensing container for a viscous substance comprising a sleeve defining an axis of rotation and having a pair of ends arranged at first and second locations along the axis, the sleeve further defining a helical travel path on an inward facing surface thereof; a dispensing member mounted in association with one of the pair of ends of the sleeve; a piston head mounted within the sleeve and defining an outward facing peripheral surface operative to cooperate with the helical travel path and further defining with the dispensing member and a portion of the sleeve extending therebetween a storage volume for the viscous substance, the piston head being operative to travel along the axis of rotation when undergoing rotation thereabout relative to the sleeve; linkage apparatus integrally formed with the piston head and defining an end portion associated with a predetermined portion of the sleeve, the linkage apparatus permitting axial displacement of the piston head relative to the predetermined portion proportional to the distance between the predetermined portion and the dispensing member; and apparatus for engaging the end portion of the linkage apparatus and thereby preventing simultaneous rotation of the piston head and the sleeve in the same direction.

Additionally in accordance with an embodiment of the invention, the container also comprises a base for receiving one of the pair of ends of the sleeve distal from the dispensing member and apparatus associated with the base for removably retaining the sleeve in a fixed position along the axis of rotation relative to the base while permitting axial rotation of the sleeve therewithin.

Further in accordance with an embodiment of the invention, the apparatus for engaging comprises a first protrusion formed on the base, the end portion of the linkage apparatus comprising an anchor member defining a second protrusion operative to become engaged with the first protrusion such that simultaneous rotation of the piston head and the sleeve in the same direction is prevented.

Additionally in accordance with an embodiment of the invention, the apparatus for retaining comprises adapter apparatus for providing a connection between the sleeve and the base and having an inward facing surface having a configuration corresponding to the configuration of an outward facing surface of the sleeve, the adapter apparatus having an outward facing surface having a configuration corresponding to a portion of the base with which the sleeve is to be connected.

According to an alternative embodiment of the invention, the sleeve and the dispensing member are integrally formed.

According to yet a further alternative embodiment of the invention, the apparatus for retaining is integrally formed with the base.

BRIEF DESCRIPTION OF THE DRAWINGS

The present invention will be understood and appreciated more fully from the following detailed description, taken in conjunction with the drawings, in which:

FIGS. 5A and 5B are respective plan view and side-sectional illustrations of the base shown in FIGS. 1, 2A and 2B;

FIG. 6 is a cross-sectional view of the dispensing member shown in FIG. 1;

FIG. 7 is a partially cut-away illustration of the adapter ring shown in FIGS. 1, 2A and 2B.

DETAILED DESCRIPTION OF A PREFERRED EMBODIMENT

Figure 1:
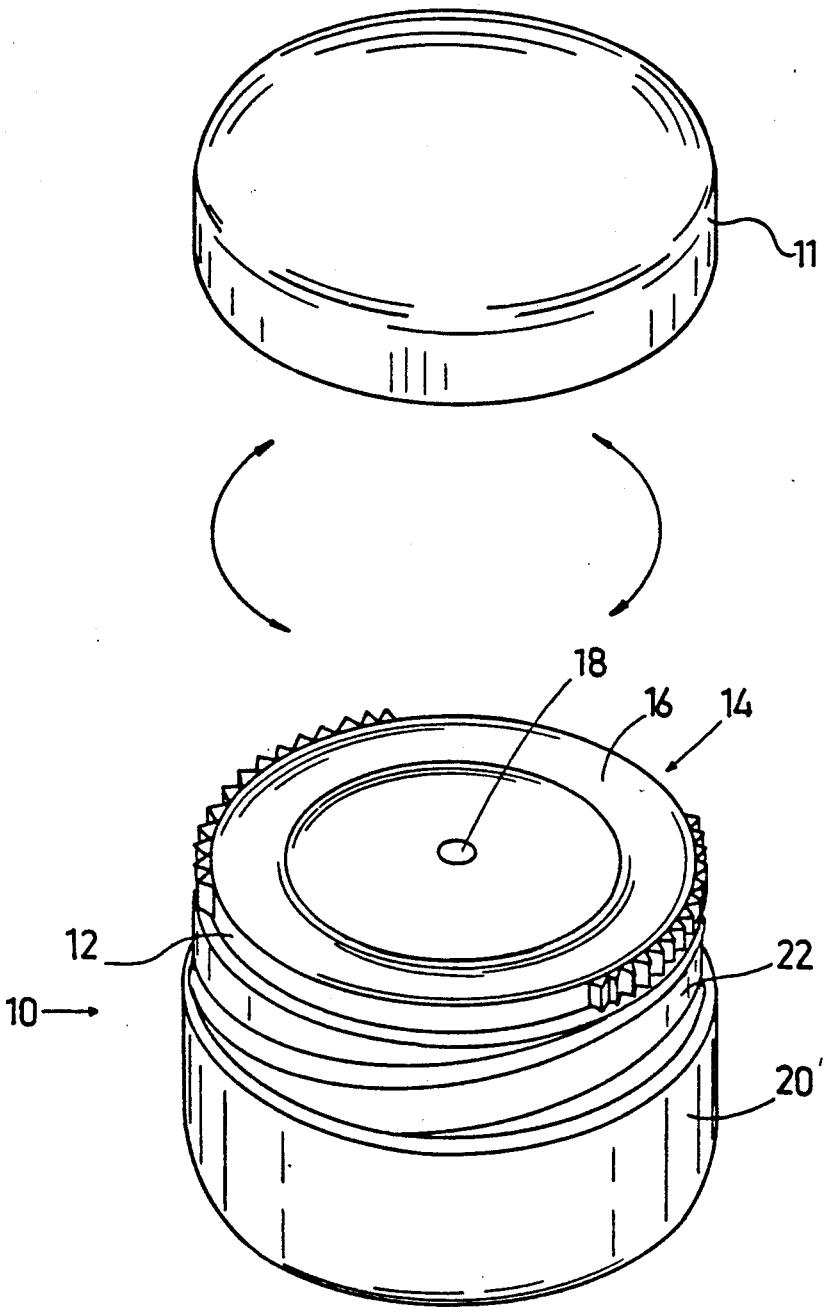
FIG. 1 is a perspective view illustration of a dispensing container for viscous substances, constructed and operative in accordance with a preferred embodiment of the invention.

Reference is made to FIG. 1, in which is shown a dispensing container, referenced generally 10, for viscous substances, such as cosmetic creams. As will become apparent from the ensuing description, container 10 is particularly characterized by its relatively simple design, and by its low production cost, the container having a small number of parts and typically being made from any suitably rigid plastic, such as polypropylene. The separate components of the container are preferably made by an injection molding technique.

Container 10 comprises, typically, a cylindrical sleeve member 12 closed at an exposed end 14 by a dispensing member 16, inserted into sleeve member 12, as shown. Member 12 comprises typically a single aperture 18 through which the viscous substance stored in container 10 may be dispensed. Sleeve member 12 is rotatably retained in a base 20 by means of an adapter ring 22. There is also provided a cover 11, which fastens onto ring 22 such as by being screwed thereon.

Reference is now made to FIGS. 2A to 7, which illustrate the various components of container 10. Sleeve 12 (FIG. 3) defines a screw thread 24 which extends substantially along its entire height and is configured to receive a piston head 26 (FIG. 4), which has on an outer surface thereof a screw thread 28, configured to cooperate with screw thread 24. Defined by an upper surface 25 of piston head 26, dispensing member 16 and an intervening portion of sleeve 12 is a viscous substance storage volume.

Figure 2A:
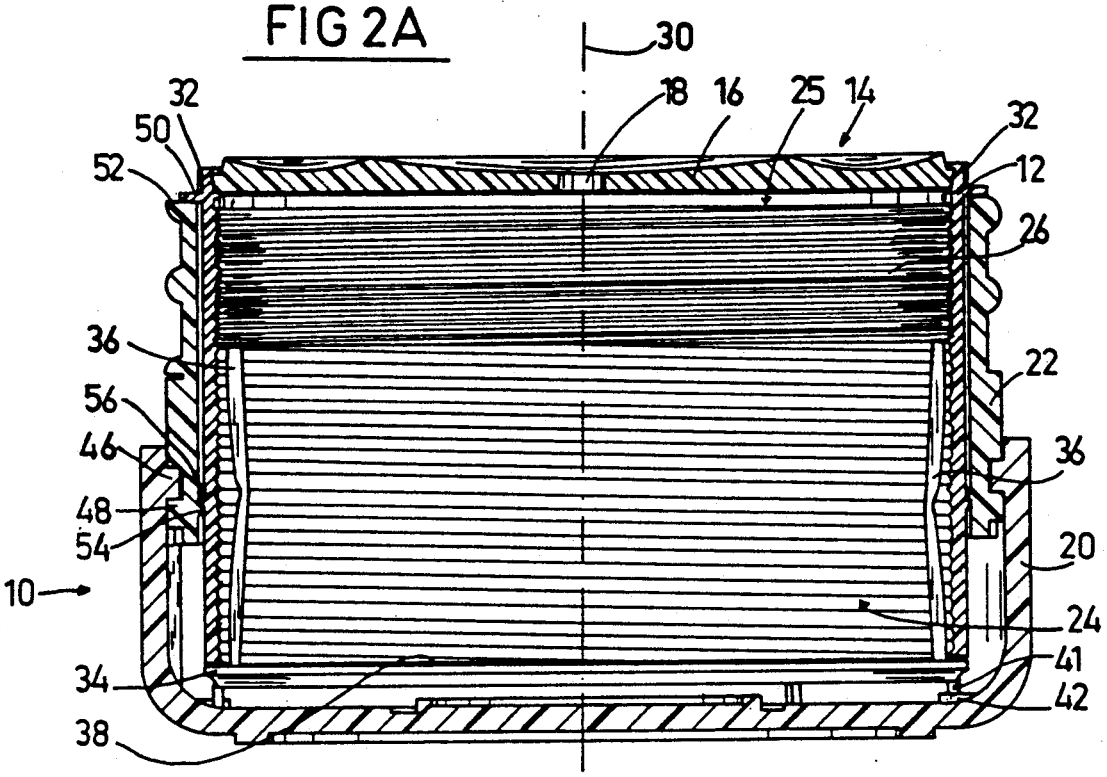
FIGS. 2A and 2B are first and second side-sectional views of the container of FIG. 1, taken at right angles to each other and showing the container when empty and full, respectively.
Figure 2B:
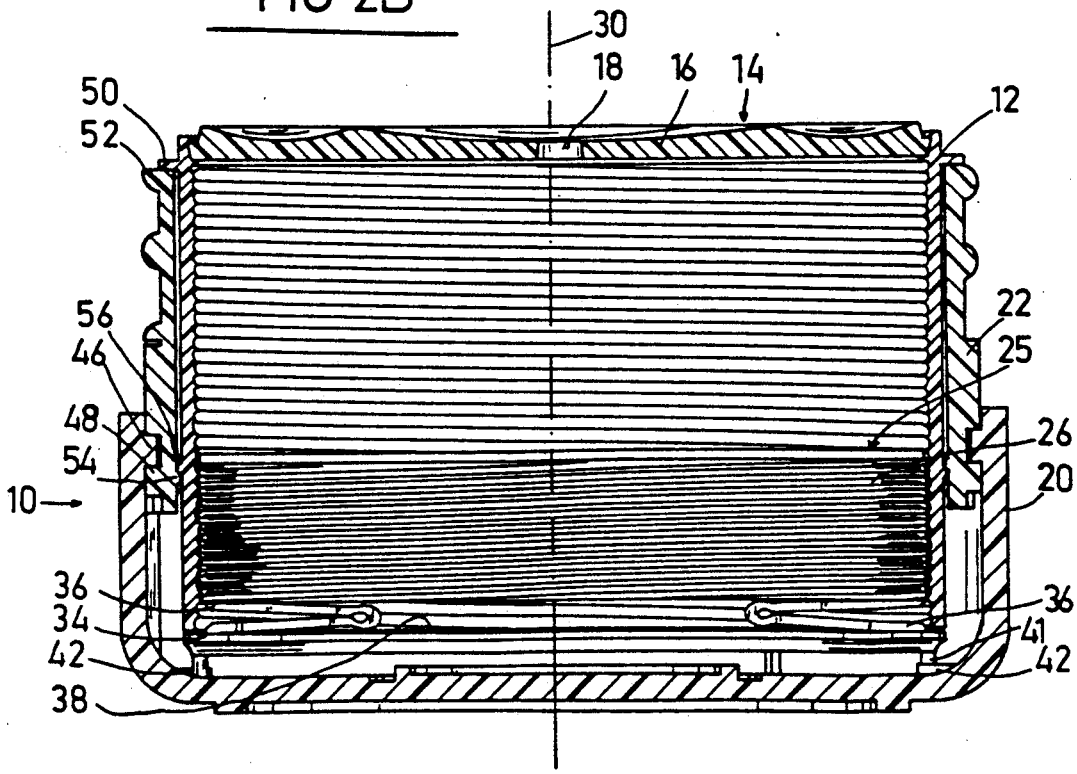
Figure 3:
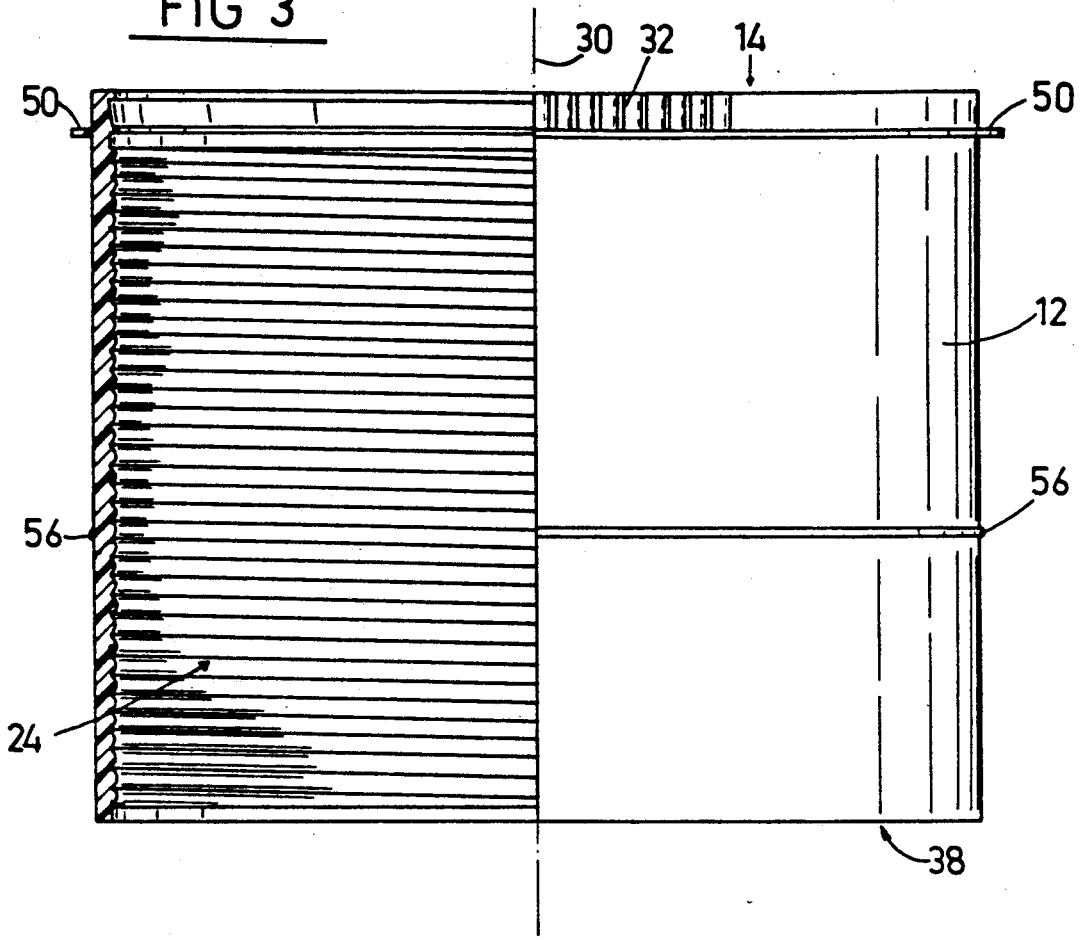
FIG. 3 is a partially cut-away illustration of the sleeve member as shown in FIGS. 2A and 2B.
Figure 4:
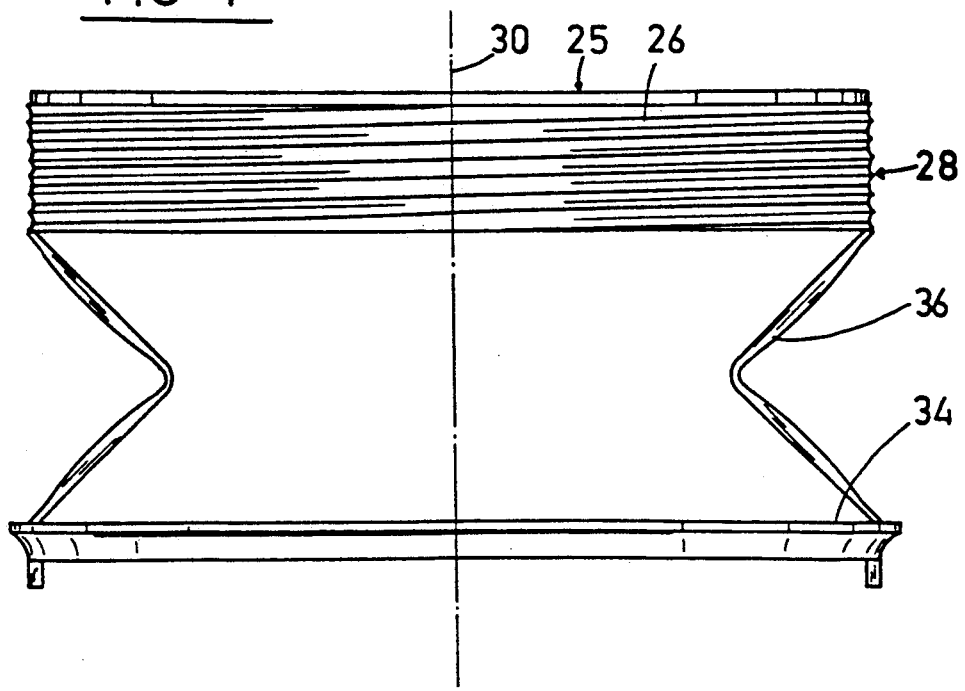
FIG. 4 is a side elevation of the integral piston head and anchor shown in FIGS. 2A and 2B.

It will be appreciated that relative rotation between piston head 26 and sleeve 12 causes relative axial motion of the piston head and the sleeve along a common axis of symmetry, referenced 30. According to the shown embodiment, sleeve 12 has hand grips 32 arranged along an upper edge thereof, so as to facilitate turning thereof. FIG. 2B shows piston head 26 in a position defining a maximum storage volume and FIG. 2A shows piston head 26 adjacent to member 16, in a position defining a negligible storage volume.

Sleeve 12 is constructed, as mentioned, so as to rotatably receive piston head 26. Connected to piston head 26 by means of flexible links 36 is a ring 34, preferably formed integrally therewith. Ring 34 has a diameter that is preferably larger than that of sleeve 12, such that when piston head 26 travels axially from a bottom end 38 of sleeve 12 to end 14 thereof, ring 34 is anchored in a fixed position adjacent to end 38 of sleeve 12.

According to a preferred embodiment of the invention, flexible links 36 are constructed such that their maximum extension corresponds to the height of sleeve 12. Accordingly, when piston head 26 is at the position shown in FIG. 2A, the links 36 are almost completely extended.

As mentioned above, relative axial motion between sleeve 12 and piston head 26 is achieved by causing relative axial rotation between the sleeve and the piston head. It is, therefore, necessary not only to anchor the piston head at end 38 of sleeve 12, as described, but also to prevent axial rotation of the piston head in order to prevent it rotating simultaneously with sleeve 12. According to the shown embodiment, this is achieved by mounting sleeve 12 in base 20 (FIGS. 2A, 2B, 5A and 5B), by means to be described.

Base 20 includes a plurality of protrusions 42 formed on a surface 44 thereof and sleeve 12 is mounted in base 20 such that protrusions 41 defined on a bottom surface of ring 34 become locked with the protrusions 42 as piston head 26 is rotated together with sleeve 12. Once the piston head has become locked, as described, only sleeve 12 may be rotated, which causes the desired relative axial movement between the sleeve and the piston head.

Sleeve 12 is rotatably mounted in base 20 by means of adapter ring 22 (FIG. 7). Adapter ring 22 is removably secured to base 20 by a first, typically annular projection 46 thereof which engages a second, typically annular projection 48 formed on an outer surface of the adapter ring.

A projection 50, formed on sleeve 12 adjacent to end 14 thereof is engaged by an upper surface 52 of adapter ring 22, while annular projection 54 of ring 22 helps to retain sleeve 12 in the position shown in FIGS. 2A and 2B by means of annular projection 56 of sleeve 12.

It will be appreciated that while base 20 is shown, by way of example, to have a particular size relative to the sleeve 12 and the other components shown, the base may have any convenient size or configuration so long as the external dimensions and, if necessary, shape, of adapter ring 22 are in accordance therewith. This feature is of particular importance in the field of cosmetics, for example, wherein it may be wished to market different products in containers of different shapes and sizes.

In operation, the viscous substance is dispensed by gripping base 20 and hand grip 32 and rotating each in an opposing direction. This induces the above-described relative rotation between sleeve 12 and piston head 26. As relative rotation is caused in a first predetermined direction, piston head 26 is driven axially along axis 30 towards member 16 thereby applying positive pressure to the viscous substance.

Depending on the viscosity of the substance and the size of the aperture 18, as the applied pressure reaches at least a critical level, the substance is dispensed through aperture 18 and may be removed from dispensing member 16 by, for example, a finger. As will be appreciated, dispensing of the substance in this manner is not only convenient and non-wasteful, but it also substantially reduces the chance of contaminating the substance by exposure to finger-borne and airborne germs.

As relative rotation is carried out in a second predetermined direction opposite to the first direction, piston head 26 is driven axially along axis 30 away from member 16 thereby applying a negative pressure to the viscous substance so as to withdraw it into the container.

Figure 8A:
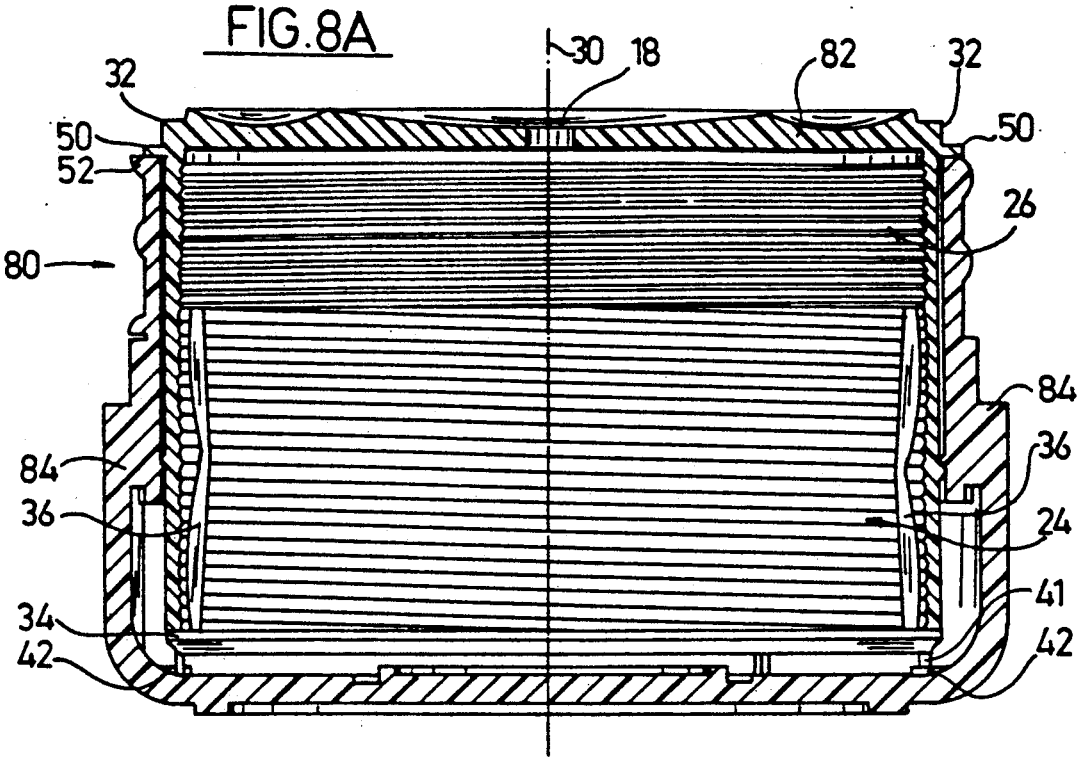
FIGS. 8A and 8B are first and second side-sectional views of the container of FIG. 1, respectively corresponding to the views of FIGS. 2A and 2B, but showing a construction according to an alternative embodiment of the invention.
Figure 8B:
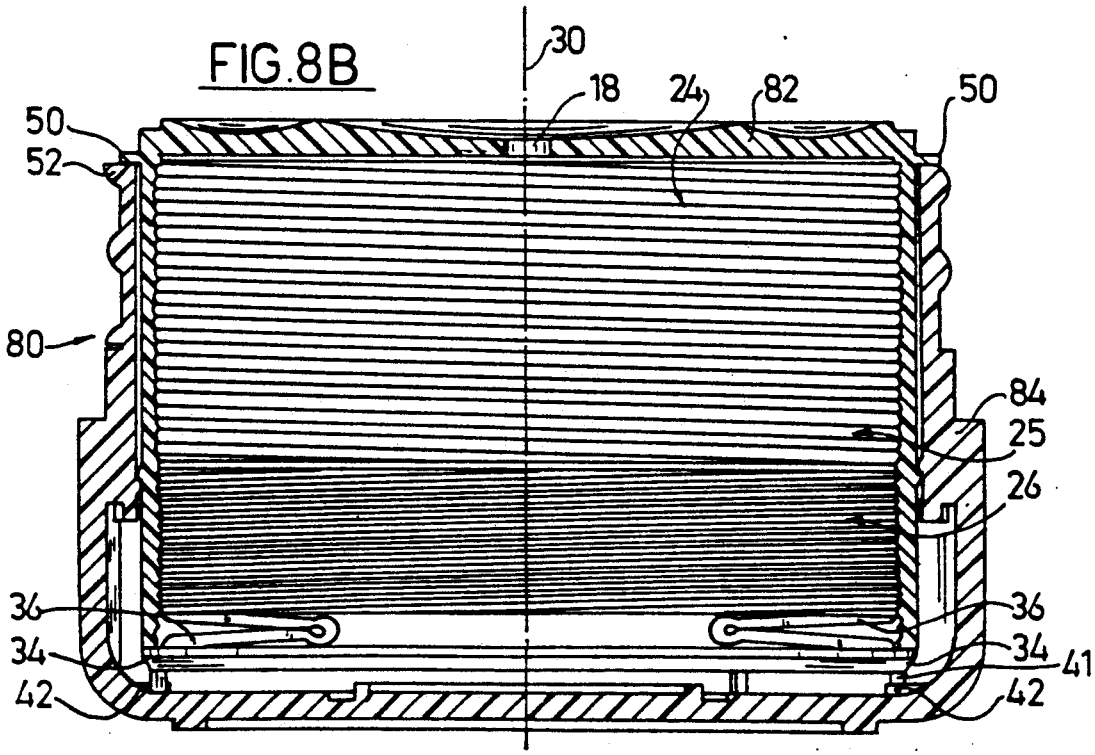

Referring now to FIGS. 8A and 8B, there is shown a container 80, constructed and operative in accordance with an alternative embodiment of the invention. Container 80 is similar in construction and operation to container 10 (FIGS. 1 to 7) and similar components bear similar reference numerals and are not specifically described again in detail in conjunction with FIGS. 8A and 8B.

Container 80 is characterized by the relatively small number of parts of which it is comprised. In place of sleeve member 12 and dispensing member 16 (FIGS. 1 to 2B) of container 10, container 80 comprises a single integral member 82 having the same general configuration and function as members 12 and 16 of container 10. In addition, in place of base 20 and adapter ring 22 (FIGS. 1 to 2B) of container 10, there is provided a single integral mounting member 84 having the same general configuration and function as base 20 and ring 22 of container 10.

It will be appreciated that due to the very small number of parts of which container 80 is comprised, manufacture and assembly of the container is relatively inexpensive. Due to the integral nature of member 82, filling of container 80 with a preferred viscous substance is carried out through hole 18, by use of any suitable apparatus. This is in contrast to the easier filling of container 10 in which the container is filled and then dispensing member 16 is fitted.

According to different embodiments of the invention, if preferred, of the two pairs of components of container 10 replaced by members 82 and 84, only one of the pair of components is replaced with its corresponding integral member, while the other pair remains as shown and described in conjunction with FIGS. 1 to 7.

It will be appreciated by persons skilled in the art that the present invention is not limited by what has been shown and described hereinabove. The scope of the present invention is limited, rather, solely by the claims, which follow:

I claim:

1. A dispensing container for a viscous substance comprising:

a sleeve defining an axis of rotation and having a pair of ends arranged at first and second locations along said axis, said sleeve further defining a helical travel path on an inward facing surface thereof;

a dispensing member mounted in association with one of said pair of ends of said sleeve;

a piston head mounted within said sleeve and defining an outward facing peripheral surface operative to cooperate with said helical travel path and further defining with said dispensing member and a portion of said sleeve extending therebetween a storage volume for the viscous substance, said piston head being operative to travel along said axis of rotation when undergoing rotation thereabout relative to said sleeve;

linkage means integrally formed with said piston head as one piece and defining an end portion associated with a predetermined portion of said sleeve, said linkage means permitting axial displacement of said piston head relative to said predetermined portion proportional to the distance between said predetermined portion and said dispensing member; and means associated with said linkage means for preventing simultaneous rotation of said piston head and said sleeve in the same direction and wherein:

said means for engaging comprises at least one first protrusion formed on said base, said end portion of said linkage means comprising an anchor member defining at least one second protrusion operative to become engaged with said at least one first protrusion such that simultaneous rotation of said piston head and said sleeve in the same direction is prevented, and said at least one first protrusion comprises four protrusions spaced radially about said axis of rotation and said at least one second protrusion comprises a pair of protrusions.

2. A dispensing container for a viscous substance comprising:

a sleeve defining an axis of rotation and having a pair of ends arranged at first and second locations along said axis, said sleeve further defining a helical travel path on an inward facing surface thereof;

a dispensing member mounted in association with one of said pair of ends of said sleeve;

a piston head mounted within said sleeve and defining an outward facing peripheral surface operative to cooperate with said helical travel path and further defining with said dispensing member and a portion of said sleeve extending therebetween a storage volume for the viscous substance, said piston head being operative to travel along said axis of rotation when undergoing rotation thereabout relative to said sleeve;

linkage means integrally formed with said piston head as one piece and defining an end portion associated with a predetermined portion of said sleeve, said linkage means permitting axial displacement of said piston head relative to said predetermined portion proportional to the distance between said predetermined portion and said dispensing member; and means associated with said linkage means for preventing simultaneous rotation of said piston head and said sleeve in the same direction.

3. A container according to claim 2, and wherein said sleeve is cylindrical.

4. A container according to claim 2, and also including a protective cover.

5. A container according to claim 2, and wherein said container is disposable.

6. A container according to claim 2 and wherein said linkage means comprises at least one foldable link.

7. A container according to claim 2, and wherein said linkage means comprises at least one flexible link.

8. A container according to claim 2 and wherein said linkage means and said piston head are integrally formed as a single piece of plastic.

9. A container according to claim 2, and wherein said dispensing member defines an aperture through which the viscous substance is dispensed.

10. A container according to claim 9, and wherein travel of said piston head along said axis of rotation towards said dispensing member causes dispensing through said aperture of the viscous substance, while travel of said piston head in an opposite direction causes withdrawal of the viscous substance through said aperture.

11. A container according to claim 2, and wherein said sleeve and said dispensing member are integrally formed.

12. A container according to claim 1, and also comprising:

a base for receiving one of said pair of ends of said sleeve distal from said dispensing member and means associated with said base for removably retaining said sleeve in a fixed position along said axis of rotation relative to said base while permitting axial rotation of said sleeve therewithin about said axis of rotation.

13. A container according to claim 12, and wherein said means for engaging comprises at least one first protrusion formed on said base, said end portion of said linkage means comprising an anchor member defining at least one second protrusion operative to become engaged with said at least one first protrusion such that simultaneous rotation of said piston head and said sleeve in the same direction is prevented.

14. A container according to claim 13, and wherein said linkage means also comprises at least one elongate extensible member.

15. A container according to claim 14, and wherein said at least one elongate member comprises a pair of elongate members.

16. A container according to claim 2, and also comprising:

a base for receiving one of said pair of ends of said sleeve distal from said dispensing member and means associated with said base for removably retaining said sleeve in a fixed position along said axis of rotation relative to said base while permitting axial rotation of said sleeve therewithin about said axis of rotation.

17. A container according to claim 16, and wherein said means for retaining comprises adapter means for providing a connection between said sleeve and said base and having an inward facing surface having a configuration corresponding to the configuration of an outward facing surface of said sleeve, said adapter means further having an outward facing surface having a configuration corresponding to a portion of said base with which said sleeve is to be connected.

18. A container according to claim 16, and wherein said means for retaining is integrally formed with said base.

19. A container according to claim 16, and wherein said base is ornamental.

20. A container according to claim 16, and wherein said means for engaging comprises at least one first protrusion formed on said base, said end portion of said linkage means comprising an anchor member defining at least one second protrusion operative to become engaged with said at least one first protrusion such that simultaneous rotation of said piston head and said sleeve in the same direction is prevented.

21. A container according to claim 20, and wherein said sleeve, said dispensing member and said piston head, said linkage means and said anchor member are formed of plastic.

22. A container according to claim 20, and wherein said linkage means also comprises at least one elongate extensible member.

23. A container according to claim 22, and wherein said at least one elongate member comprises a pair of elongate members.

* * * * *